US009141035B2

(12) United States Patent
Yamazaki

(10) Patent No.: US 9,141,035 B2
(45) Date of Patent: Sep. 22, 2015

(54) DEVELOPING DEVICE FORMING TONER IMAGE BY FEEDING TONER TOWARD ELECTROSTATIC LATENT IMAGE FORMED ON CIRCUMFERENTIAL SURFACE OF PHOTOSENSITIVE DRUM, AND IMAGE FORMING APPARATUS INCLUDING THE SAME

(71) Applicant: KYOCERA Document Solutions Inc., Osaka (JP)

(72) Inventor: Hiroshi Yamazaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/453,498

(22) Filed: Aug. 6, 2014

(65) Prior Publication Data

US 2015/0050040 A1 Feb. 19, 2015

(30) Foreign Application Priority Data

Aug. 13, 2013 (JP) ..... 2013-168330

(51) Int. Cl.
*G03G 15/09* (2006.01)
*G03G 15/08* (2006.01)

(52) U.S. Cl.
CPC ..... *G03G 15/0942* (2013.01); *G03G 15/0812* (2013.01)

(58) Field of Classification Search
CPC ..... G03G 15/0942; G03G 15/0812
USPC ..... 399/103, 274, 104
See application file for complete search history.

(56) References Cited

U.S. PATENT DOCUMENTS

2007/0140729 A1 * 6/2007 Carter et al. ..... 399/103

FOREIGN PATENT DOCUMENTS

JP 08-137275 A 5/1996
JP 08137275 A * 5/1996

* cited by examiner

*Primary Examiner* — Susan Lee
(74) *Attorney, Agent, or Firm* — Knobbe, Martens, Olson & Bear LLP

(57) ABSTRACT

A developing device includes a developing roller, a regulating blade, and seal members. The regulating blade extends in a rotation axis direction of the developing sleeve, is disposed opposite to a circumferential surface of the developing sleeve, and regulates a quantity of the toner present on the circumferential surface of the developing sleeve. The seal members are disposed opposite to the circumferential surface of the developing sleeve without being in contact with both ends of the developing sleeve in the rotation axis direction, and inhibit the toner on the circumferential surface from moving to the rotation axis direction ends by magnetic brushes formed between the magnet roller and the seal members. An inner surface part of each seal member which is opposite to the circumferential surface of the developing sleeve has root parts which have crest parts formed in a serrated shape.

4 Claims, 10 Drawing Sheets

DEVELOPING DEVICE FORMING TONER IMAGE BY FEEDING TONER TOWARD ELECTROSTATIC LATENT IMAGE FORMED ON CIRCUMFERENTIAL SURFACE OF PHOTOSENSITIVE DRUM, AND IMAGE FORMING APPARATUS INCLUDING THE SAME

INCORPORATION BY REFERENCE

This application claims priority to Japanese Patent Application No. 2013-168330 filed on Aug. 13, 2013, the entire contents of which are incorporated by reference herein.

BACKGROUND

This disclosure relates to a developing device that forms a toner image by feeding toner toward an electrostatic latent image formed on a circumferential surface of a photosensitive drum by electrophotography and an image forming apparatus having the same, and particularly to a technique for preventing leakage of toner on a circumferential surface of a developing sleeve.

In such an electrophotographic image forming apparatus, a toner image is formed by feeding toner from a developing device toward an electrostatic latent image formed on a surface of a photosensitive drum. Such a developing device has a developing roller made up of a magnet roller and a developing sleeve, forms a toner layer on a circumferential surface of the developing sleeve, and feeds the toner from the developing sleeve to the surface of the photosensitive drum. The developing sleeve of the developing device is provided with seal members at both ends thereof in a rotation axis direction thereof. The seal members are opposite to the circumferential surface of the developing sleeve, and inhibit the toner on the circumferential surface from moving to the ends in the rotation axis direction and leaking out of the ends. Thus, a developing device A is proposed in which a root part guiding the toner on the developing sleeve into a developing zone is provided for an inner circumferential surface of each seal member in order to more reliably prevent the leakage of the toner.

SUMMARY

As an aspect of this disclosure, a technique further improving the aforementioned technique is proposed.

A developing device according to an aspect of this disclosure includes a developing roller, a regulating blade, and seal members.

The developing roller is configured to have a magnet roller having numerous magnetic poles in a circumferential direction thereof and a roller-shaped developing sleeve sheathed on the magnet roller, and to feed toner to a photosensitive drum.

The regulating blade is configured to extend in a rotation axis direction of the developing sleeve, is disposed opposite to a circumferential surface of the developing sleeve, and is configured to regulate a quantity of the toner present on the circumferential surface of the developing sleeve.

The seal members are disposed opposite to the circumferential surface of the developing sleeve without being in contact with opposite ends of the developing sleeve in the rotation axis direction, and are configured to inhibit the toner on the circumferential surface from moving to the rotation axis direction ends by magnetic brushes formed between the magnet roller and the seal members.

Also, an inner surface part of each seal member which is opposite to the circumferential surface of the developing sleeve has root parts which extend in the rotation axis direction of the developing sleeve and which have crest parts formed in a serrated shape when viewed from a side in the rotation axis direction.

An image forming apparatus according to an aspect of this disclosure includes an image carrier, a charging part, an exposing part, and the developing device.

A toner image is formed on a surface of the image carrier.

The charging part charges the surface of the image carrier.

The exposing part exposes the surface of the image carrier which is charged by the charging part, and forms an electrostatic latent image.

DETAILED DESCRIPTION

Figure 1:
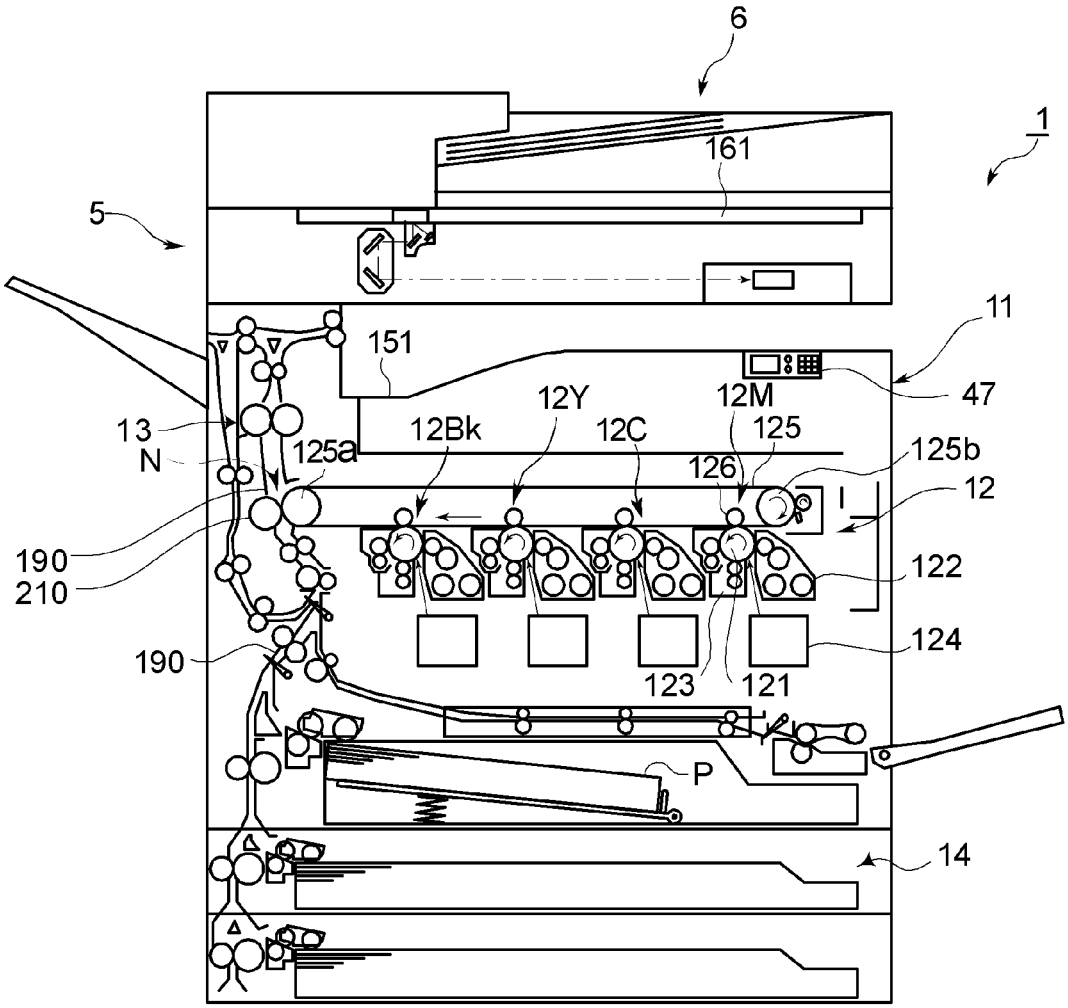
FIG. 1 is a front cross-sectional view illustrating a structure of an image forming apparatus having a developing device according to an embodiment of this disclosure.

Hereinafter, a developing device and an image forming apparatus having the same according to an embodiment of this disclosure will be described with reference to the drawings. FIG. 1 is a front cross-sectional view illustrating a structure of an image forming apparatus having a developing device according to an embodiment of this disclosure.

An image forming apparatus 1 according to an embodiment of this disclosure is, for instance, a multifunction device combining numerous functions such as a copy function, a printer function, a scanner function, and a facsimile function. The image forming apparatus 1 includes an apparatus main body 11 equipped with an operation unit 47, an image forming unit 12, a fixing unit 13, a paper feed unit 14, a document feed unit 6, and a document scanning unit 5.

When the image forming apparatus 1 performs a document scanning operation, the document scanning unit 5 optically scans an image of a document fed by the document feed unit 6 or an image of a document placed on a document table glass 161 to generate image data. The image data generated by the document scanning unit 5 is stored in an internal hard disk drive (HDD) or a networked computer.

When the image forming apparatus 1 performs an image forming operation, the image forming unit 12 forms toner images on recording paper P as a recording medium fed from the paper feed unit 14 based on the image data generated by the document scanning operation or the image data stored in the internal HDD. Each of image forming units 12M, 12C, 12Y, and 12Bk of the image forming unit 12 is equipped with a photosensitive drum 121, a charging device 123, an exposing device 124, a developing device 122, and a primary transfer roller 126.

The developing device 122 of each of the image forming units 12M, 12C, 12Y, and 12Bk contains toner for developing an electrostatic latent image. The developing device 122 supplies the corresponding toner to a surface of the photosensitive drum 121 after the toner is charged by the charging device 123 and is exposed by the exposing device 124.

When color printing is carried out, the image forming unit 12M for magenta, the image forming unit 12C for cyan, the image forming unit 12Y for yellow, and the image forming unit 12Bk for black of the image forming unit 12 cause the toner images to be formed on photosensitive drums 121 by charging, exposing, and developing processes based on images composed of respective color components constituting the image data, and cause the toner images to be transferred to an intermediate transfer belt 125 stretched on a driving roller 125*a* and a driven roller 125*b* by primary transfer rollers 126.

The intermediate transfer belt 125 has image carrying surfaces to which the toner images are transferred and which are set for an outer circumferential surface thereof, and is driven by the driving roller 125*a* in contact with circumferential surfaces of the photosensitive drums 121. The intermediate transfer belt 125 endlessly travels between the driving roller 125*a* and the driven roller 125*b* while being synchronized with each photosensitive drum 121.

Each chromatic toner image transferred onto the intermediate transfer belt 125 is superposed on the intermediate transfer belt 125 by adjusting transfer timing, and becomes a color toner image. A secondary transfer roller 210 causes the color toner image formed on the surface of the intermediate transfer belt 125 to be transferred to the recording paper P, which is conveyed from the paper feed unit 14 along a conveying path 190, at a nip zone N across the intermediate transfer belt 125 between the secondary transfer roller 210 and the driving roller 125*a*. Afterwards, the fixing unit 13 causes the toner image on the recording paper P to be fixed to the recording paper P by thermocompression. The recording paper P on which the fixing process is completed and on which a color image is formed is ejected to an eject tray 151.

Figure 2:
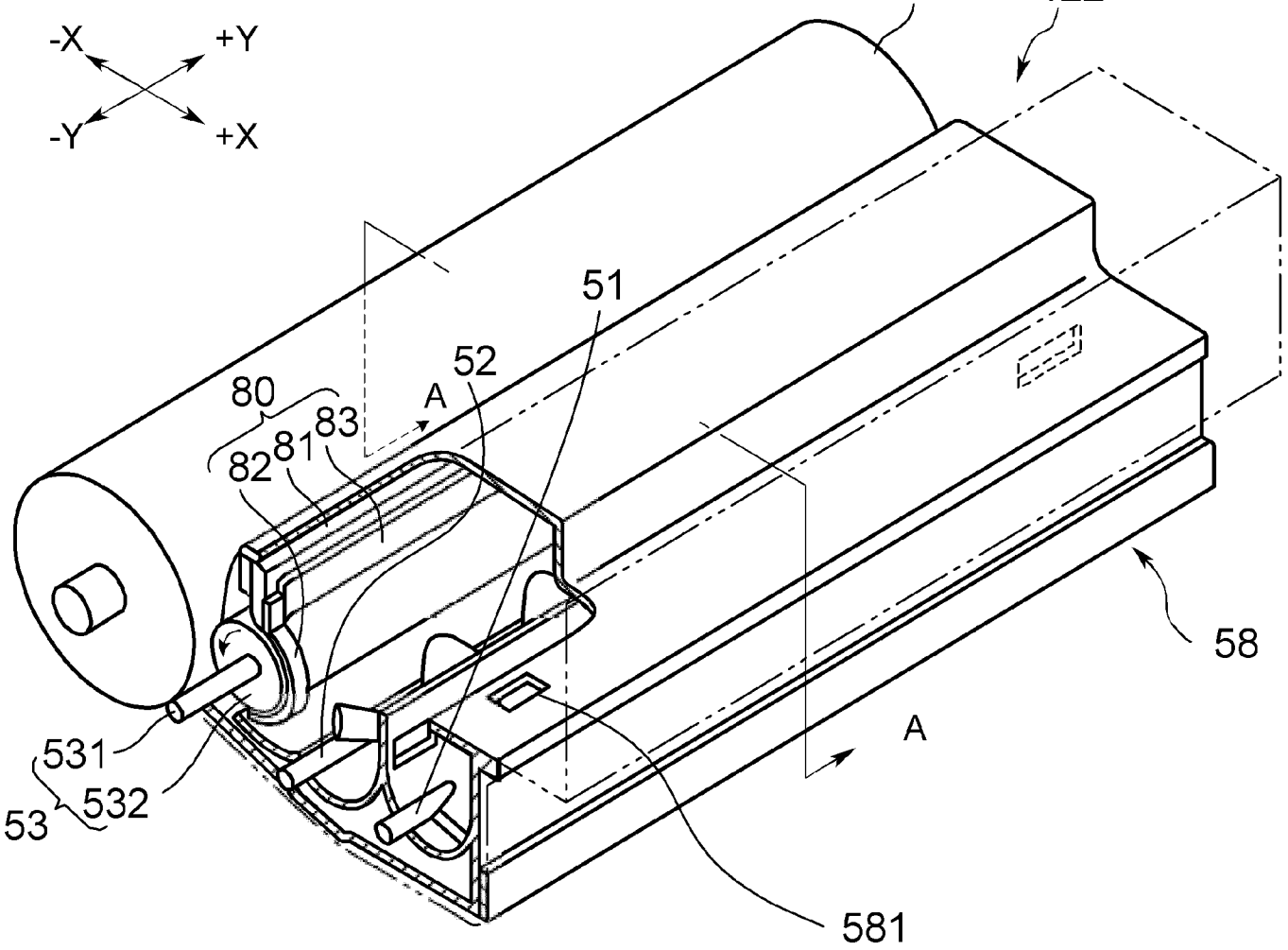
FIG. 2 is a perspective view illustrated by cutting out a part of the developing device.
Figure 3:
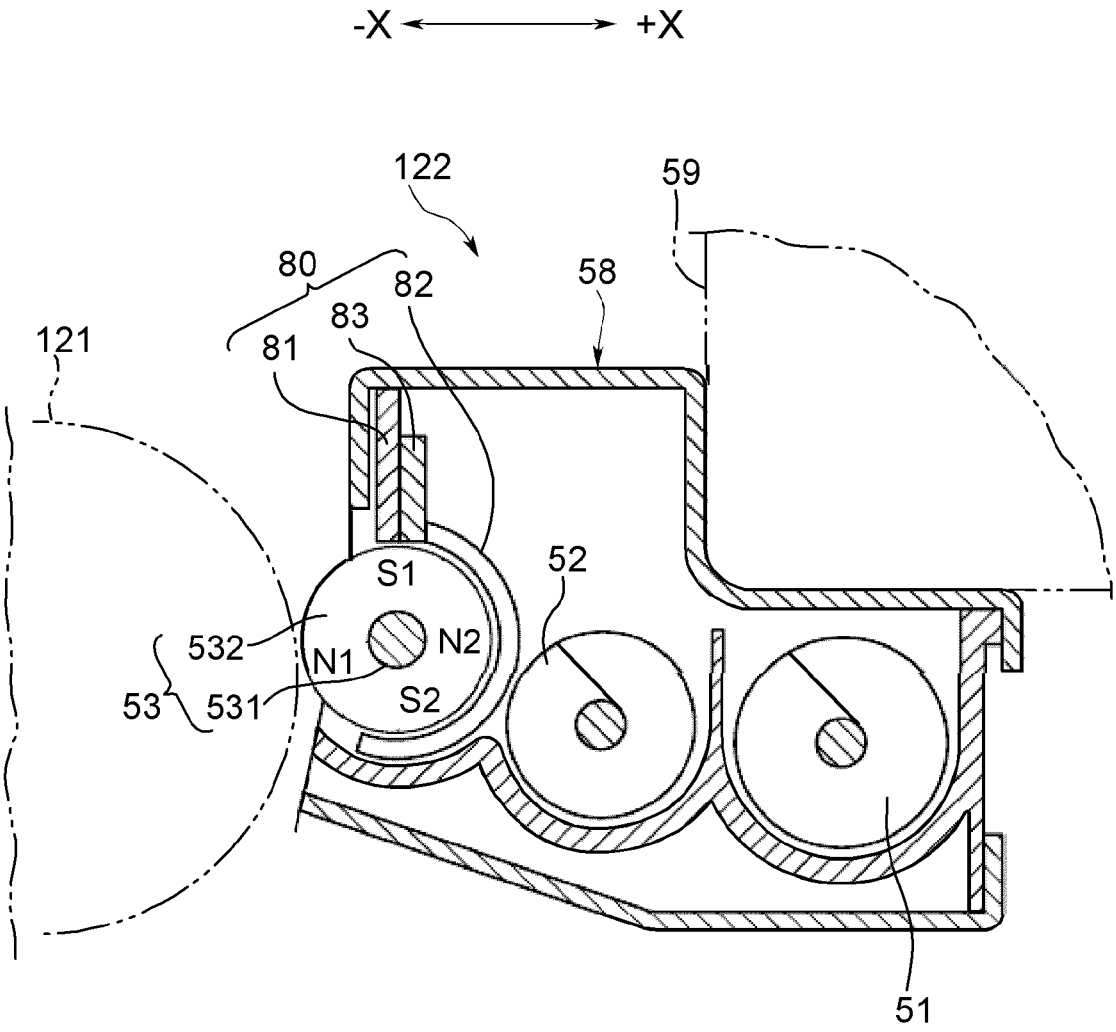
FIG. 3 is a cross-sectional view taken along line A-A in FIG. 2.

Next, a constitution of the developing device 122 will be described. FIG. 2 is a perspective view illustrated by cutting out a part of the developing device 122. FIG. 3 is a cross-sectional view taken along line A-A in FIG. 2. In FIGS. 2 and 3, an X-X direction is referred to as a leftward/rightward direction, and a Y-Y direction is referred to as a frontward/rearward direction. Particularly, a −X direction is referred to as a left side, a +X direction as a right side, a −Y direction as a front side, and a +Y direction as a rear side.

As illustrated in FIGS. 2 and 3, the developing device 122 is equipped with a first spiral feeder 51, a second spiral feeder 52, and a developing roller 53 in a casing 58.

The first spiral feeder 51 conveys toner replenished from a toner container 59 toward the rear side while agitating the toner. The second spiral feeder 52 conveys the toner handed from the first spiral feeder 51 toward the front side. The developing roller 53 receives the toner conveyed by the second spiral feeder 52 and supplies the toner to a latent image region of the circumferential surface of the photosensitive drum 121.

The developing roller 53 includes a magnet roller 531 and a developing sleeve 532. The developing sleeve 532 is sheathed on the magnet roller 531. The developing sleeve 532 is rotatably supported by the casing 58 at a position adjacent to the surface of the photosensitive drum 121 and the second spiral feeder 52. The developing sleeve 532 is formed of a nonmagnetic material such as aluminum in a cylindrical shape, and a surface roughness Rz thereof is finished to, for instance, 10 μm or less.

The magnet roller (magnetic member) 531 is a permanent magnet that is fixedly installed in the developing sleeve 532. The magnet roller 531 has numerous magnetic poles made up of S and N poles that are alternately arranged in a circumferential direction, and generates a magnetic field toward the developing sleeve 532. Further, the developing roller 53 is exposed from an opening of the casing 58, and is opposite to the photosensitive drum 121 that is an image carrier at a fixed distance. Such an opposite region becomes a developing region for supplying the toner carried on the developing sleeve 532 toward the photosensitive drum 121. To supply the toner to the photosensitive drum 121, a developing bias obtained by superposing alternating current on direct current is applied to the developing sleeve 532.

For example, a magnetic pole S1 is disposed at a position of the magnet roller 531 which is located opposite to a regulating blade 81. Further, a magnetic pole N1 is disposed at a position facing the developing region. Furthermore, a magnetic pole S2 is disposed on a toner circulation region to which remaining toner after development is conveyed. In addition, a magnetic pole N2 is disposed at a position facing the second spiral feeder 52.

The toner, which is fed from the toner container 59 through a toner feed opening 581 of the casing 58 by a magnetic force of the magnet roller 531 and moves from the first and second spiral feeders 51 and 52, is carried on the circumferential surface of the developing sleeve 532. Further, the toner is fed to the first spiral feeder 51 from a toner container (not shown) through the toner feed opening 581 of the casing 58.

The regulating blade 81 regulates the toner carried on the circumferential surface of the developing sleeve 532 to a predetermined layer thickness, and is supported above the developing sleeve 532 by the casing 58 at a predetermined distance from the surface of the developing sleeve 532.

The toner carried on the circumferential surface of the developing sleeve 532 is regulated to a predetermined layer thickness by the regulating blade 81, and is conveyed toward the developing region by rotation of the developing sleeve 532 (in an arrow direction of FIG. 2). As a developing bias is applied to the developing sleeve 532, a potential difference occurs between the developing sleeve 532 and the photosensitive drum 121 in the developing region. Thus, the toner on the developing sleeve 532 moves to the photosensitive drum 121, and an electrostatic latent image on the photosensitive drum 121 is developed into a toner image.

A toner quantity adjustment mechanism 80 including the regulating blade 81 is arranged at a position facing the circumferential surface of the developing sleeve 532.

Figure 4:
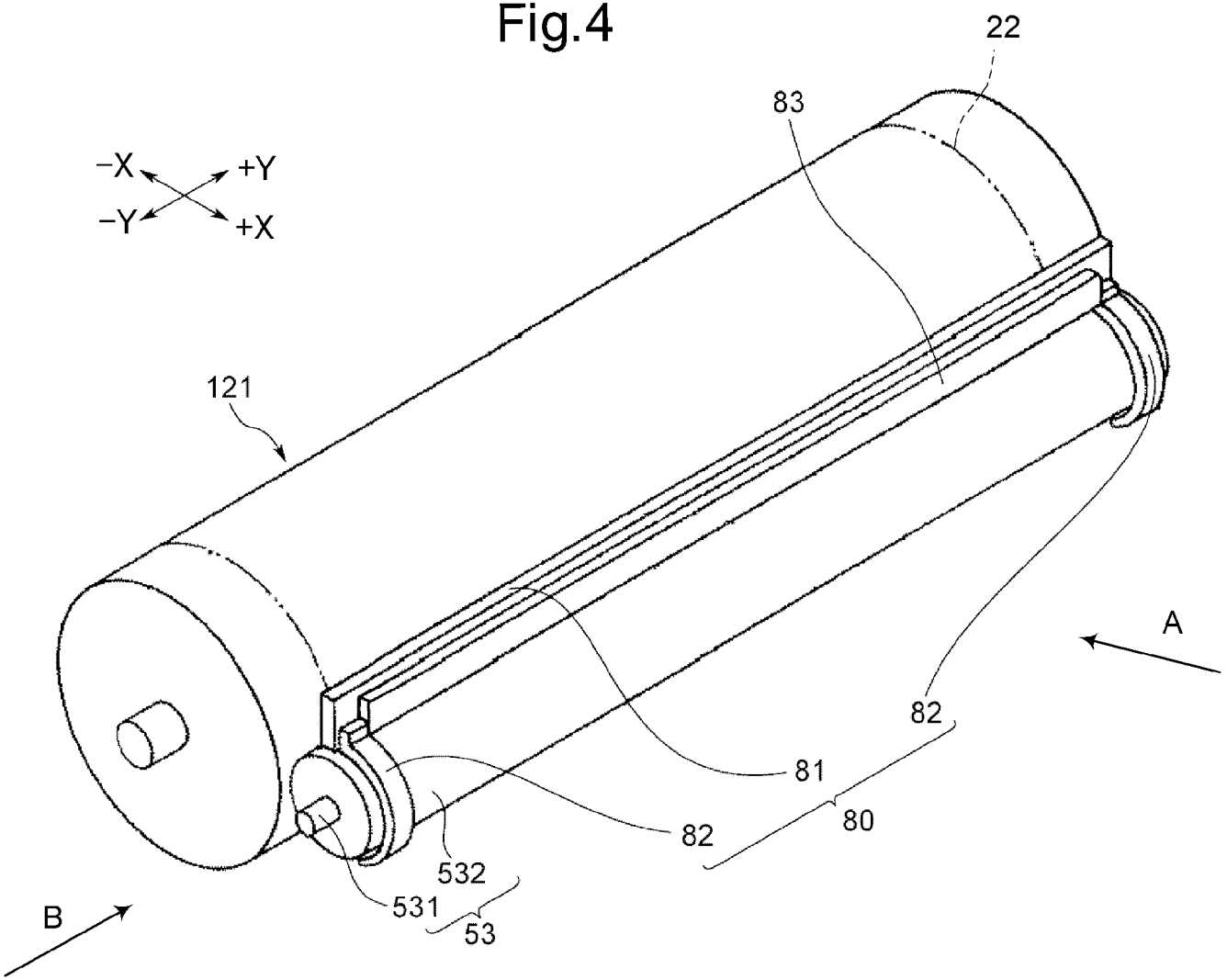
FIG. 4 is a perspective view illustrating portions of a toner quantity adjustment mechanism, a developing roller, and a photosensitive drum.
Figure 5:
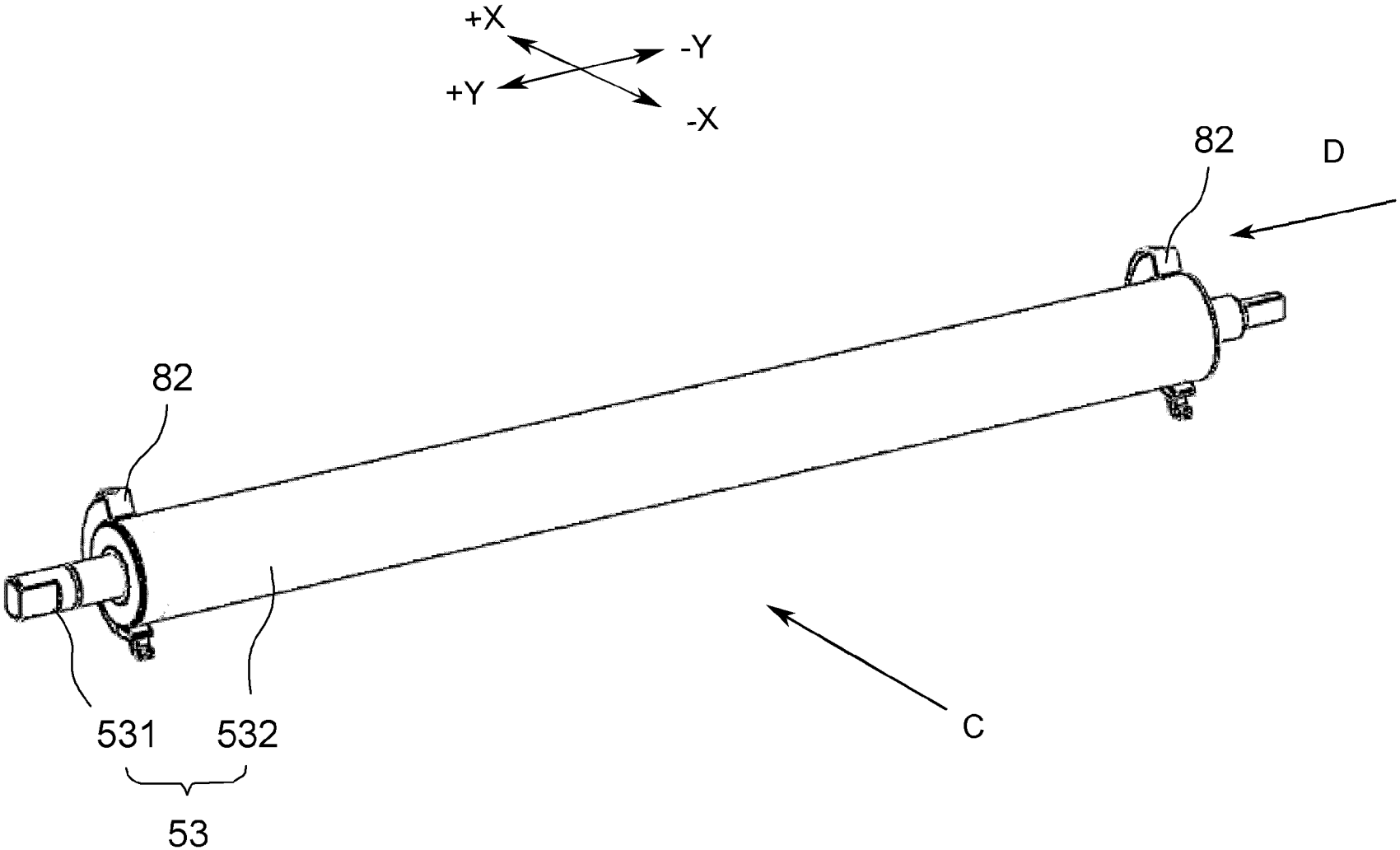
FIG. 5 is a perspective view illustrating portions of the developing roller and seal members.
Figure 6:
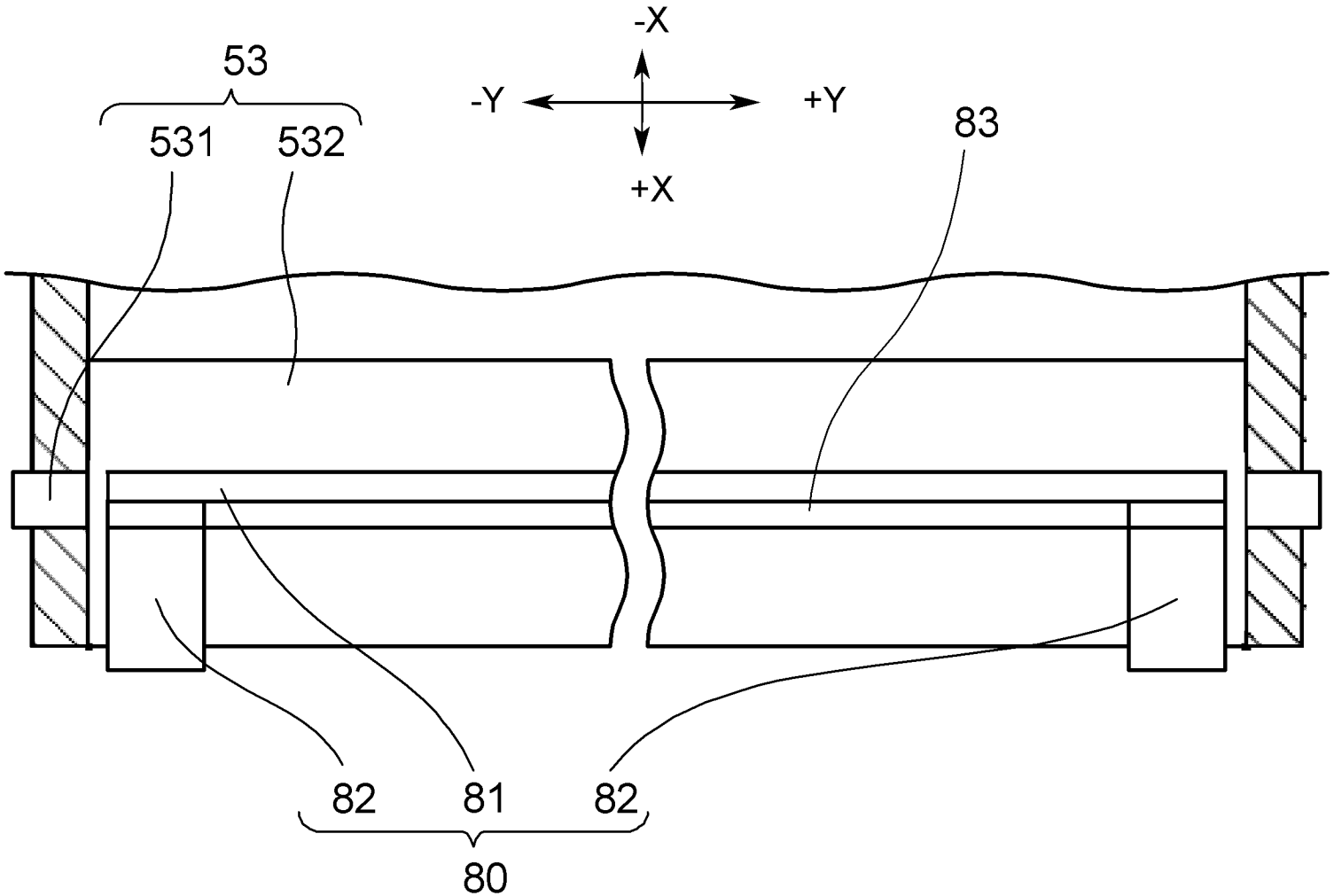
FIG. 6 is a top view illustrating the portions of the toner quantity adjustment mechanism, the developing roller, and the photosensitive drum.
Figure 7:
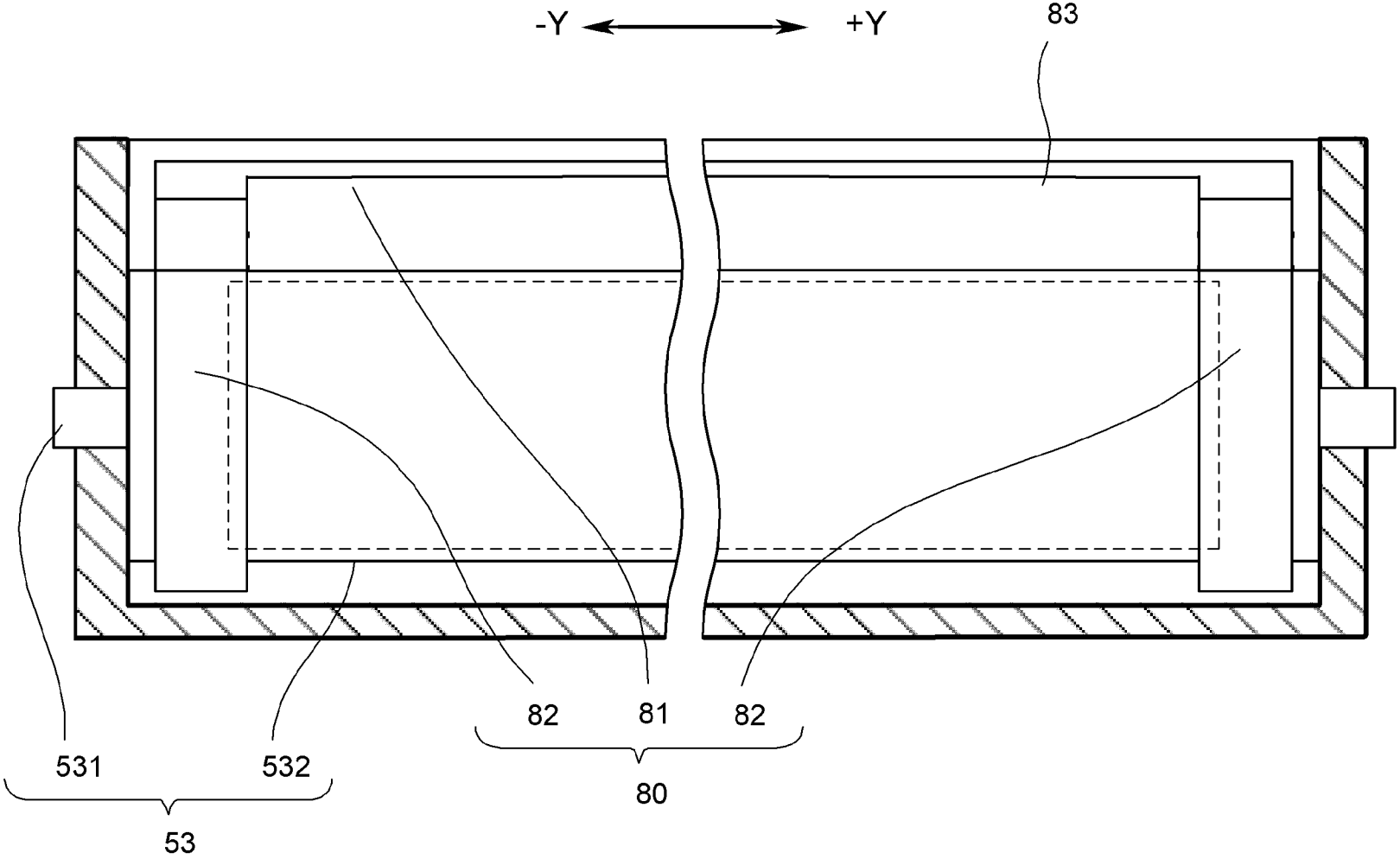
FIG. 7 is a side view of the portions of the toner quantity adjustment mechanism, the developing roller, and the photosensitive drum seen in a direction of arrow A of FIG. 4.
Figure 8:
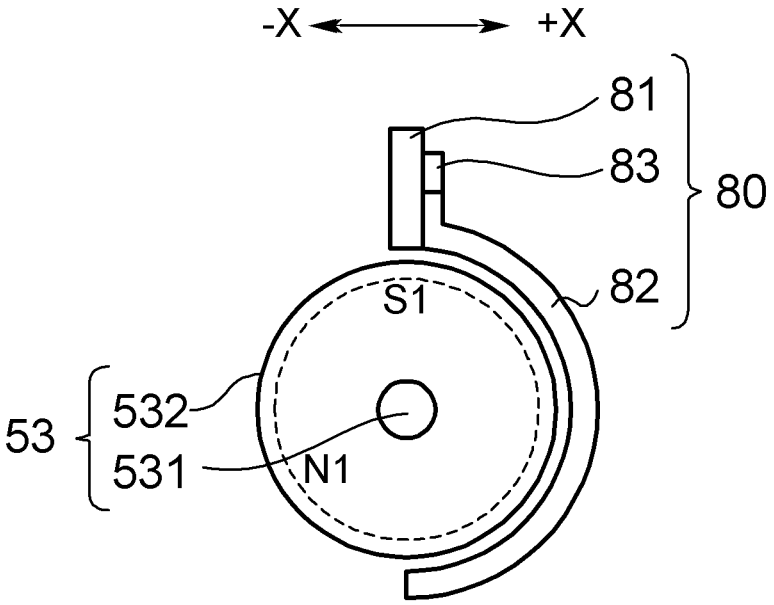
FIG. 8 is a side view of the portions of the toner quantity adjustment mechanism, the developing roller, and the photosensitive drum seen in a direction of arrow B of FIG. 4.
Figure 9:
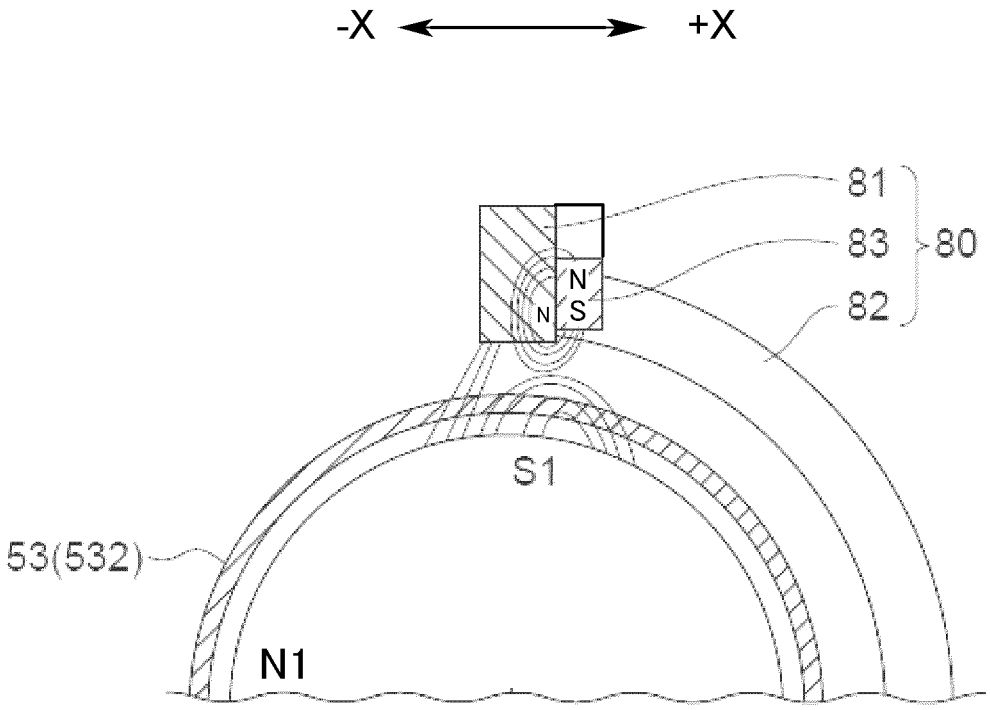
FIG. 9 is a side view of the portions of the toner quantity adjustment mechanism, the developing roller, and the photosensitive drum seen in a direction of arrow B of FIG. 4.

FIG. 4 is a perspective view illustrating portions of the toner quantity adjustment mechanism 80, the developing roller 53, and the photosensitive drum 121. FIG. 5 is a perspective view illustrating portions of the developing roller 53 and seal members 82. FIG. 6 is a top view illustrating the portions of the toner quantity adjustment mechanism 80, the developing roller 53, and the photosensitive drum 121. FIG. 7 is a side view of the portions of the toner quantity adjustment mechanism 80, the developing roller 53, and the photosensitive drum 121 seen in a direction of arrow A of FIG. 4. FIGS. 8 and 9 are side views of the portions of the toner quantity adjustment mechanism 80, the developing roller 53, and the photosensitive drum 121 seen in a direction of arrow B of FIG. 4. Direction indication based on X and Y in FIGS. 4 to 9 is the same as in FIG. 2 (X is the leftward/rightward direction (−X: left side, +X: right side), and Y is the frontward/rearward direction (−Y: front side, +Y: rear side)). Hereinafter, the toner quantity adjustment mechanism 80 will be described with reference to FIGS. 4 to 9 and FIGS. 1 to 3 above.

First, as illustrated in FIG. 4, the toner quantity adjustment mechanism 80 includes the regulating blade 81, the seal member 82, and a blade magnet 83.

The seal members 82 are made of a magnetic member, and are disposed at respective both ends of the developing sleeve 532 in a rotation axis direction of the developing sleeve 532 while facing the circumferential surface of the developing sleeve 532. The seal members 82 inhibit the toner on the circumferential surface of the developing sleeve 532 from moving to the end side in the rotation axis direction.

The blade magnet 83 is made of a magnetic member, and is mounted on the regulating blade 81 between arrangement positions of the seal members 82 in a longitudinal direction of the regulating blade 81. The blade magnet 83 is a lateral part of the regulating blade 81, and is mounted on an upstream side of the regulating blade 81 which is located in a direction in which the circumferential surface of the developing sleeve 532 rotates. The blade magnet 83 is configured such that its edge adjacent to the developing sleeve 532 becomes the same S pole as the magnetic pole S1 of the magnet roller 531 inside the developing sleeve 532, and the opposite edge thereto becomes an N pole.

The regulating blade 81 regulates a quantity of the toner fed to the latent image region 22 (the region in which the electrostatic latent image between two-dot chain lines illustrated in FIG. 4 is formed, i.e. the developing region) of the circumferential surface of the photosensitive drum 121 by the rotation of the circumferential surface of the developing sleeve 532, to prevent the toner from being fed excessively. The regulating blade 81 is provided to cross the developing sleeve 532 in the rotation axis direction of the developing sleeve 532 at a position facing the circumferential surface of the developing sleeve 532. A tip edge of the regulating blade 81 is formed in an edge shape, and is opposite to the circumferential surface of the developing sleeve 532. The tip edge is provided at a predetermined distance from the circumferential surface of the developing sleeve 532.

The regulating blade 81 is made of a long blade-like member, and is formed of, for instance, a magnetic material such as stainless steel. As illustrated in FIG. 9, due to a magnetic force of the blade magnet 83, a tip of the regulating blade 81 which is located near the developing sleeve 532 is magnetized into the opposite polarity (N pole) of an end of the blade magnet 83 which is located opposite to the tip. Also, a magnetic field is formed between the tip of the regulating blade 81 and the blade magnet 83. Thus, a magnetic field is formed between the tip of the regulating blade 81 and the developing sleeve 532 by the magnetic poles of the magnet roller 531 in the developing roller 53 and the magnetic poles of the blade magnet 83. Due to these magnetic fields, the toner passes through a gap between the regulating blade 81 and the developing sleeve 532 in a nearly uniform state, and thus a thin layer of toner is formed on the developing sleeve 532.

The seal members 82 prevent the toner from moving from a middle circumferential surface to the ends of the developing sleeve 532 in the rotation axis direction of the developing sleeve 532 until the toner on the circumferential surface of the developing sleeve 532 reaches the arrangement position of the regulating blade 81. The seal members 82 are formed in an arcuate shape in which a central angle of curvature is set to about 180° when viewed from the front (seen in a B direction of FIG. 4). As illustrated in FIG. 8, for example, an upper end of each seal member 82 is fixed in contact with a right-hand side of the regulating blade 81. A lower end of each seal member 82 is supported by a part of the casing 58. Thereby, the seal members 82 are arranged at a fixed distance from the circumferential surface of the developing sleeve 532. The distance is set to, for instance, 0.1 mm to 1 mm.

According to the seal members 82, magnetic brushes caused by lines of magnetic force between the seal members 82 and the magnet roller 531 mounted in the developing sleeve 532 are formed. Since the magnetic brushes regulate the movement of the toner toward the end sides of the developing sleeve 532 in the rotation axis direction of the developing sleeve 532, the toner is prevented from moving from the circumferential surface to the ends of the developing sleeve 532.

As illustrated in FIG. 7, installation positions of opposite ends of the blade magnet 83 in the frontward/rearward direction of the developing sleeve 532 (in a leftward/rightward direction on the sheet of FIG. 7) are set to be positions of lateral ends of the seal members 82.

For example, a positional relation between the seal member 82 and the magnet roller 531 is set such that an end of the magnet roller 531 and an end of the seal member 82 overlap in a longitudinal direction of the developing sleeve 532.

Here, the magnetic brush formed between the developing roller 53 and the seal member 82 has a magnetic flux density that is highest at an edge of an inner surface part (a surface facing the developing sleeve 532) of the seal member 82, and that is weakened at an inner surface part entering the seal member 82 in the longitudinal direction.

When the end of the magnet roller 531 excessively enters up to a position of the inner surface part of the seal members 82 past the edge of the seal member 82 in the longitudinal direction, concentration of the magnetic brush is damaged, the toner is transported to the end side of the developing sleeve 532 relative to the edge of the seal member 82, and toner leakage is liable to take place. Further, even when the end of the magnet roller 531 does not reach the edge of the seal member 82 in the longitudinal direction, a magnetic force of constraint is weakened at the edge, and the toner is liable to leak out.

In consideration of these as well as backlash in the longitudinal direction when the magnet roller 531 is installed, a position of the end of the magnet roller 531 in the longitudinal direction is set to, for instance, the outside (the end side of the developing sleeve 532 in the longitudinal direction) from the edge of the seal member 82 by 2 mm. This causes the magnetic brush to be further concentrated on the edge of the inner surface part of the seal members 82. Further, the seal members 82 are arranged at the opposite side of the photosensitive drum 121 by way of the developing sleeve 532.

In this way, the blade magnet 83 and the seal members 82 are mounted on the regulating blade 81. Thereby, the toner on the circumferential surface of the developing sleeve 532 can be properly fed to the circumferential surface of the photosensitive drum 121, and the toner is prevented from thickening on the circumferential surfaces of the ends of the developing sleeve 532 in the rotation axis direction of the developing sleeve 532.

Next, the seal members 82 mounted on the developing roller 53 will be described. FIG. 10A is a side view of the seal member 82 seen in a direction of arrow C of FIG. 5, and FIG. 10B is a side view of the seal member 82 seen in a direction of arrow D of FIG. 5.

As illustrated in FIG. 10A, root parts 822 extending in the rotation axis direction of the developing sleeve 532 are formed in the seal member 82, particularly in the inner surface part 821 of the seal member 82 which is opposite to the outer circumferential surface of the developing sleeve 532. In the present embodiment, the numerous root parts 822 are formed.

Figure 10B:
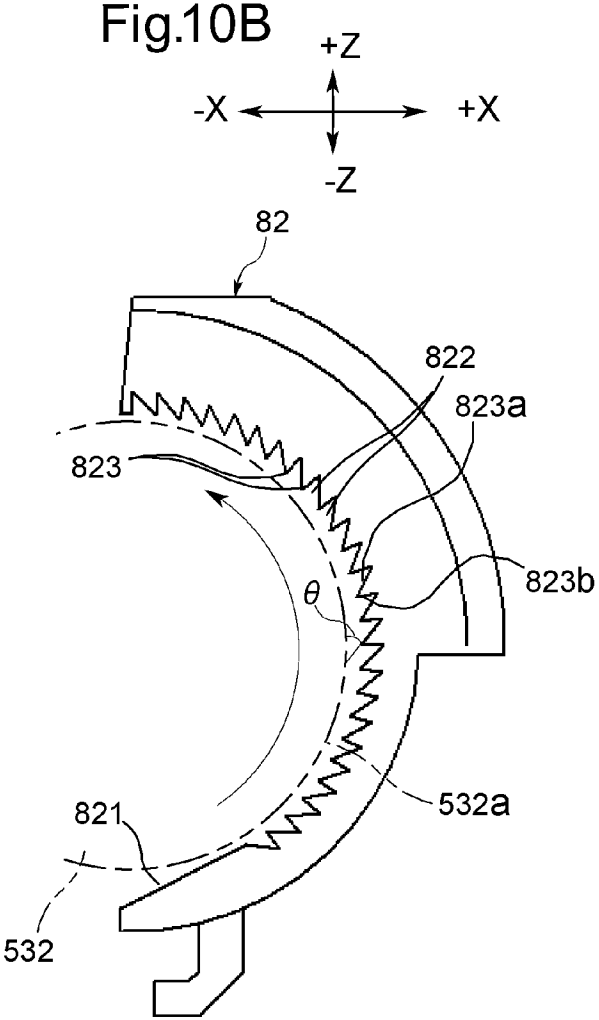
FIG. 10B is a side view of a seal member seen in a direction of arrow D of FIG. 5.
Figure 10A:
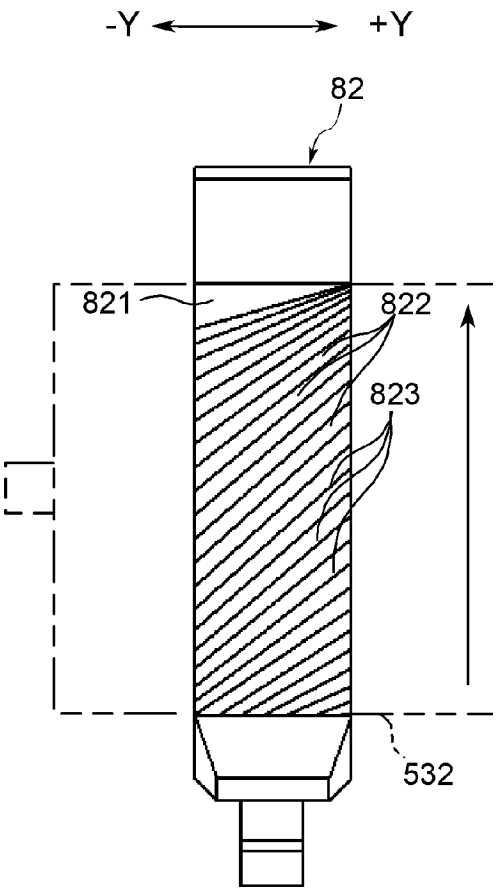
FIG. 10A is a side view of a seal member seen in a direction of arrow C of FIG. 5.

Further, as illustrated in FIG. 10B, the inner surface part 821 of the seal member 82 has numerous crest parts 823 due to the presence of the root parts 822. The crest parts 823 are formed in a serrated shape when viewed from the side in the rotation axis direction of the developing sleeve 532.

In this way, since the serrated crest parts 823 are formed at the inner surface part 821 of the seal member 82, when a magnetic field is formed between the seal member 82 and the magnet roller 531, the magnetic field is generated by concentration on the crest parts 823, particularly tips of the crest parts 823. For this reason, a magnetic constraint force caused by the magnetic brush is strengthened, and sealability to inhibit the toner from moving to the rotation axis direction end of the developing sleeve 532 is improved. The leakage of the toner directed to the outside of the developing region in the rotation axis direction can be more reliably prevented.

Further, when viewed from the side, each crest part 823 has flanks 823*a* and 823*b*. Of the flanks 823*a* and 823*b*, the flank 823*a* at a downstream side in the rotational direction of the circumferential surface of the developing sleeve 532 (the arrow direction illustrated in FIGS. 10A and 10B) is formed to be longer than the flank 823*b* at an upstream side as illustrated in FIG. 10B. An angle θ formed between the flank 823*a* at the downstream side and the circumferential surface 532*a* of the developing sleeve 532 becomes an acute angle.

In other words, the flank 823*b* at the upstream side in the rotational direction of the circumferential surface of the developing sleeve 532 extends in a direction adjacent to the rotational center of the developing sleeve 532, compared to the flank 823*a*. Further, the flank 823*a* at the downstream side in such a rotational direction extends toward a position deviating from the rotational center of the developing sleeve 532.

Thereby, since the toner moving in the rotational direction of the circumferential surface of the developing sleeve 532 between the circumferential surface of the developing sleeve 532 and the seal member 82 can reliably enter the root parts 822, a quantity of the toner accumulated between the circumferential surface of the developing sleeve 532 and the seal member 82 can be reduced, and the sealability can be further improved.

For example, in the developing device A illustrated in the section BACKGROUND, one root part formed to extend in the rotational direction of the circumferential surface of the developing sleeve is provided. As such, the function of inhibiting the toner on the circumferential surface of the developing sleeve from moving to the end in the rotation axis direction is insufficient, and still more improvement is required.

In contrast, according to the present embodiment, as described above, the toner on the circumferential surface of the developing sleeve is more reliably inhibited from moving to the ends of the developing sleeve in the rotation axis direction of the developing sleeve, so that the leakage of toner can be prevented.

Further, as shown in FIG. 10A, each root part 822 extends in such a manner that the central side of the developing sleeve 532 in the rotation axis direction of the developing sleeve 532 is inclined toward the downstream side in the rotational direction of the circumferential surface of the developing sleeve 532.

For this reason, even when a quantity of the toner between the circumferential surface of the developing sleeve 532 and the seal member 82 is increased, the toner entering each root part 822 moves to the central side of the developing sleeve 532 in the rotation axis direction of the developing sleeve 532 along the inclination of each root part 822, i.e. to the developing region side of the circumferential surface of the developing sleeve 532. Thus, the toner accumulated between the circumferential surface of the developing sleeve 532 and the seal member 82 is reduced, and the sealability can be further improved. Further, as described above, due to the crest parts 823 in which the downstream flank 823*a* is longer than the upstream flank 823*b*, and in which the angle θ formed between the flank 823*a* and the circumferential surface 532*a* of the developing sleeve 532 becomes an acute angle, the reliability of causing the toner to enter the root parts 822 is improved. Due to synergy with the reliability improvement, the toner can be caused to more reliably move to the developing region side of the circumferential surface of the developing sleeve 532.

This disclosure is not limited to the constitutions of the embodiments, but various modifications are possible. The constitution and processing illustrated in each embodiment using FIGS. 1 to 10B) are merely one embodiment of this disclosure, and the constitution and processing of this disclosure are not limited thereto.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A developing device comprising:

a developing roller configured to include a magnet roller having numerous magnetic poles in a circumferential direction thereof and a roller-shaped developing sleeve sheathed on the magnet roller and to feed toner to a photosensitive drum;

a regulating blade configured to extend in a rotation axis direction of the developing sleeve, disposed opposite to a circumferential surface of the developing sleeve, and configured to regulate a quantity of the toner present on the circumferential surface of the developing sleeve; and seal members disposed opposite to the circumferential surface of the developing sleeve without being in contact with both ends of the developing sleeve in the rotation axis direction, and configured to inhibit the toner on the circumferential surface from moving to the rotation axis direction ends by magnetic brushes formed between the ma net roller and the seal members, wherein an inner surface part of each seal member which is opposite to the circumferential surface of the developing sleeve has root parts which extend in the rotation axis direction of the developing sleeve and which have crest parts formed in a serrated shape when viewed from a side in the rotation axis direction, and the seal members are configured such that, of flanks constituting each of the crest parts when viewed from the side, the flank at a downstream side in a rotational direction of the circumferential surface of the developing sleeve is formed to be longer than the flank at an upstream side, and an angle formed between the flank at the downstream side and the circumferential surface of the developing sleeve becomes an acute angle.

2. An image forming apparatus comprising:

a photosensitive drum, on a surface of which a toner image is formed;

a charging part configured to charge the surface of the photosensitive drum;

an exposing part configured to expose the surface of the photosensitive drum, which is charged by the charging part, to form an electrostatic latent image; and the developing device according to claim 1.

3. A developing device comprising:

a developing roller configured to include a magnet roller having numerous magnetic poles in a circumferential direction thereof and a roller-shaped developing sleeve sheathed on the magnet roller and to feed toner to a photosensitive drum;

a regulating blade configured to extend in a rotation axis direction of the developing sleeve, disposed opposite to a circumferential surface of the developing sleeve, and configured to regulate a quantity of the toner present on the circumferential surface of the developing sleeve; and seal members disposed opposite to the circumferential surface of the developing sleeve without being in contact with both ends of the developing sleeve in the rotation axis direction, and configured to inhibit the toner on the circumferential surface from moving to the rotation axis direction ends by magnetic brushes formed between the magnet roller and the seal members, wherein an inner surface part of each seal member which is opposite to the circumferential surface of the developing sleeve has root parts which extend in the rotation axis direction of the developing sleeve and which have crest parts formed in a serrated shape when viewed from a side in the rotation axis direction, and the seal members are configured such that flanks at an upstream side in a rotational direction of the circumferential surface of the developing sleeve extend in a direction adjacent to a rotational center of the developing sleeve compared to flanks at a downstream side, and the flanks at the downstream side extend toward a position deviating from the rotational center of the developing sleeve.

4. A developing device comprising:

a developing roller configured to include a magnet roller having numerous magnetic poles in a circumferential direction thereof and a roller-shaped developing sleeve sheathed on the tenet roller and to feed toner to a photosensitive drum;

a regulating blade configured to extend in a rotation axis direction of the developing sleeve, disposed opposite to a circumferential surface of the developing sleeve, and configured to regulate a quantity of the toner present on the circumferential surface of the developing sleeve; and seal members disposed opposite to the circumferential surface of the developing sleeve without being in contact with both ends of the developing sleeve in the rotation axis direction, and configured to inhibit the toner on the circumferential surface from moving to the rotation axis direction ends by magnetic brushes formed between the ma net roller and the seal members, wherein an inner surface part of each seal member which is opposite to the circumferential surface of the developing sleeve has root parts which extend in the rotation axis direction of the developing sleeve and which have crest parts formed in a serrated shape when viewed from a side in the rotation axis direction, and the root parts extend to be inclined toward a downstream side in a rotational direction of the circumferential surface of the developing sleeve as the root parts approach the center of the developing sleeve in the rotation axis direction.

* * * * *